US011500306B2

(12) United States Patent
Ikebata

(10) Patent No.: US 11,500,306 B2
(45) Date of Patent: Nov. 15, 2022

(54) IMAGE FORMING APPARATUS INCLUDING TONER CONTAINER WITH CHANGEABLE ATTITUDE

(71) Applicant: KYOCERA Document Solutions Inc., Osaka (JP)

(72) Inventor: Yoshiaki Ikebata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/330,138

(22) Filed: May 25, 2021

(65) Prior Publication Data

US 2021/0389695 A1 Dec. 16, 2021

(30) Foreign Application Priority Data

Jun. 11, 2020 (JP) ..... JP2020-101466

(51) Int. Cl.
*G03G 15/08* (2006.01)

(52) U.S. Cl.
CPC ..... *G03G 15/0891* (2013.01); *G03G 15/0872* (2013.01); *G03G 2215/0668* (2013.01)

(58) Field of Classification Search
CPC ..... G03G 15/0872; G03G 15/0891
See application file for complete search history.

(56) References Cited

FOREIGN PATENT DOCUMENTS

| | | | | |
|---|---|---|---|---|
| JP | 2004286793 | A | | 10/2004 |
| JP | 2011170218 | A | * | 9/2011 |
| JP | 2016004194 | A | * | 1/2016 |
| JP | 2020154262 | A | * | 9/2020 |

* cited by examiner

*Primary Examiner* — Walter L Lindsay, Jr.
*Assistant Examiner* — Andrew V Do
(74) *Attorney, Agent, or Firm* — Alleman Hall Creasman & Tuttle LLP

(57) ABSTRACT

An image forming apparatus includes a toner container, a toner conveyance portion, a container attachment portion, and a biasing mechanism. The toner container has a toner outflow port at a tip portion thereof. The toner conveyance portion is provided in the toner container and conveys toner in the toner container toward the toner outflow port. The container attachment portion supports the toner container. The biasing mechanism applies a biasing force to change the toner container from a horizontal attitude to an inclined attitude in accordance with a toner conveyance operation of the toner conveyance portion. When the toner container is in the inclined attitude, the toner outflow port faces diagonally downward.

5 Claims, 10 Drawing Sheets

IMAGE FORMING APPARATUS INCLUDING TONER CONTAINER WITH CHANGEABLE ATTITUDE

INCORPORATION BY REFERENCE

This application is based upon and claims the benefit of priority from the corresponding Japanese Patent Application No. 2020-101466 filed on Jun. 11, 2020, the entire contents of which are incorporated herein by reference.

BACKGROUND

The present disclosure relates to an image forming apparatus configured to support a toner container.

An electrophotographic image forming apparatus is provided with a developing device. Developer including toner is stored inside the developing device. The image forming apparatus includes a container attachment portion to which a toner container is attached. When the toner container is attached to the container attachment portion, the toner is replenished from the toner container to the developing device.

As one example of the toner container that is attached to the image forming apparatus, there is known an elongated toner container that is laid transversely. In this type of toner container, a toner outflow port is formed at a tip of the toner container, and the toner is conveyed to outside from the toner outflow port in a state where the toner container is laid transversely.

SUMMARY

An image forming apparatus according to an aspect of the present disclosure includes a toner container, a toner conveyance portion, a container attachment portion, and a biasing mechanism. The toner container has a toner outflow port at a tip portion thereof. The toner conveyance portion is provided in the toner container and conveys toner in the toner container toward the toner outflow port. The container attachment portion supports the toner container. The biasing mechanism applies a biasing force to change the toner container from a horizontal attitude to an inclined attitude in accordance with a toner conveyance operation of the toner conveyance portion, wherein when the toner container is in the inclined attitude, the toner outflow port faces diagonally downward.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
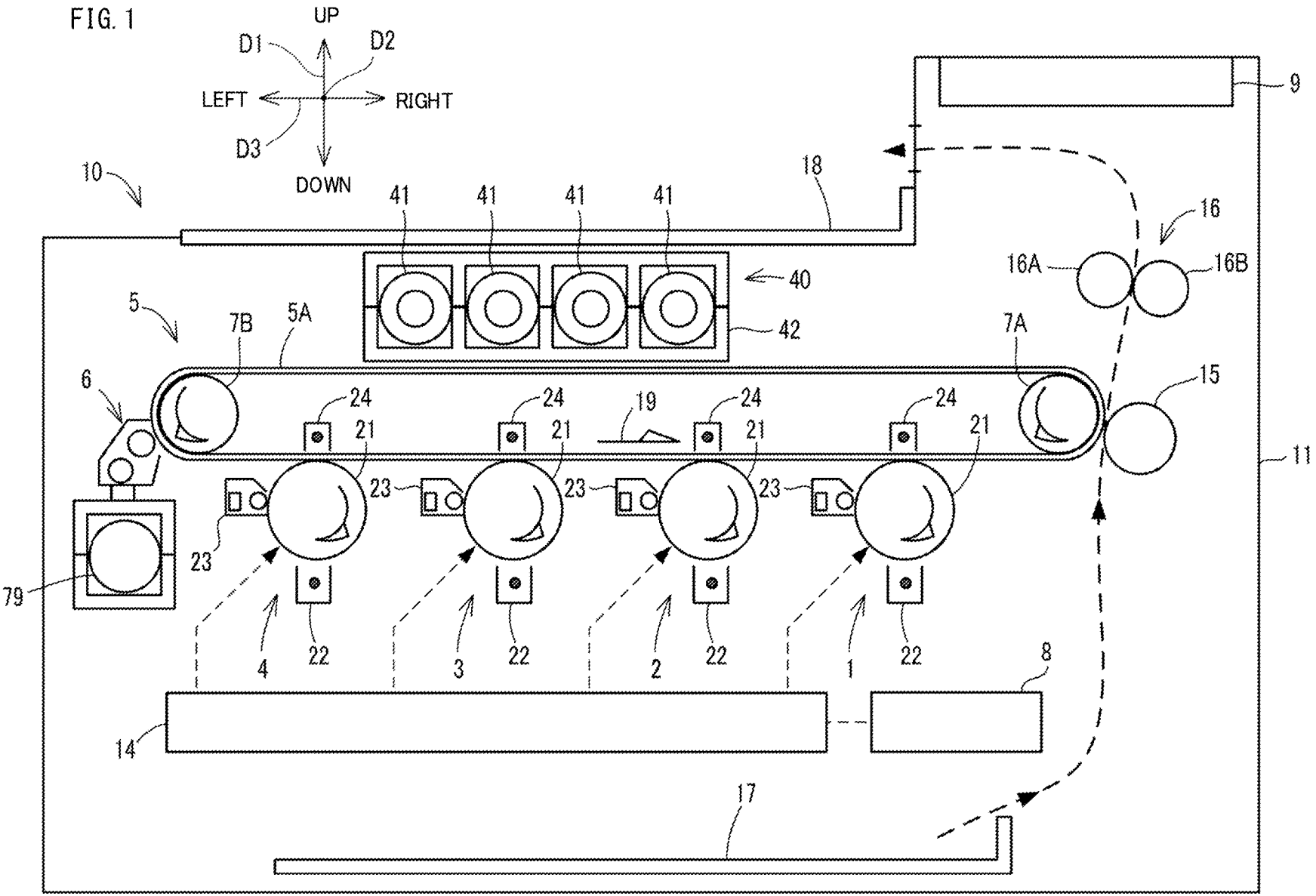
FIG. 1 is a diagram showing a configuration of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure. It is noted that an up-down direction D1, a front-rear direction D2, and a left-right direction D3 that are indicated in the drawings may be used in the following description.

[Image Forming Apparatus]

An image forming apparatus 10 has at least a print function and is, for example, a color printer. The image forming apparatus 10 prints an image on a print sheet that is a sheet member, by using developer including toner. It is noted that a specific example of the image forming apparatus 10 is, for example, a printer, a copier, a facsimile, or a multifunction peripheral having these functions. In addition, although the image forming apparatus 10 is configured to form a color image, it may be configured to form a monochrome image as far as it uses a toner container 41.

As shown in FIG. 1, the image forming apparatus 10 is what is called a tandem-type color image forming apparatus. The image forming apparatus 10 includes a plurality of image forming portions 1 to 4, an intermediate transfer unit 5, an exposure device 14, a secondary transfer device 15, a fixing device 16, a toner replenishment device 40, a belt cleaning device 6, an operation/display portion 9 including a touch panel and a liquid crystal display portion, a control portion 8, a sheet feed tray 17, and a sheet discharge tray 18. These components are provided in a housing 11 that constitutes an external frame (not shown), an internal frame and the like of the image forming apparatus 10.

The image forming portions 1 to 4 are configured to form, by what is called an electrophotographic method, toner images of different colors on a plurality of photoconductor drums 21, respectively. The toner images are transferred to a running (moving) intermediate transfer belt 5A such that the toner images are overlaid with each other thereon. In the example shown in FIG. 1, an image forming portion 1 for black, an image forming portion 2 for yellow, an image forming portion 3 for cyan, and an image forming portion 4 for magenta are arranged in alignment in the stated order from the downstream in a moving direction (a direction indicated by the arrow 19) of the intermediate transfer belt 5A.

The image forming portions 1 to 4 are provided below the intermediate transfer belt 5A. Each of the image forming portions 1 to 4 includes a photoconductor drum 21 carrying a toner image thereon, a charging device 22, a developing device 23, and a primary transfer device 24. The surface of the photoconductor drum 21 is electrically charged by the charging device 22, and the charged surface of the photoconductor drum 21 is exposed to and scanned by the exposure device 14. This allows an electrostatic latent image to be formed on the surface of the photoconductor drum 21. The developing device 23 develops the electrostatic latent image with the toner. Subsequently, the toner image on the photoconductor drum 21 is transferred to the intermediate transfer belt 5A by the primary transfer device 24.

The intermediate transfer unit 5 includes the intermediate transfer belt 5A, a driving roller 7A, and a driven roller 7B. The intermediate transfer belt 5A carries a toner image that is formed from toner images of a plurality of (in the present embodiment, four) colors. The intermediate transfer belt 5A is supported by the driving roller 7A and the driven roller 7B so as to be rotatably driven by them. This makes it possible for the intermediate transfer belt 5A to rotate while its surface is in contact with surfaces of the photoconductor drums 21. When the intermediate transfer belt 5A is rotationally driven, its surface passes through between the photoconductor drums 21 and the primary transfer devices 24. At this time, the toner images of the different colors carried by the plurality of photoconductor drum 21 are transferred in sequence to the intermediate transfer belt 5A in such a way as to be overlaid with each other thereon.

The toner replenishment device 40 is provided above the intermediate transfer unit 5. The toner replenishment device 40 includes a container attachment portion 42 to which four toner containers 41 respectively corresponding to colors black, yellow, cyan, and magenta are attached. The container attachment portion 42 is configured such that the toner containers 41 can be attached thereto and detached therefrom. The configuration of the toner replenishment device 40 is described below.

The secondary transfer device 15 transfers the toner image that has been transferred to the intermediate transfer belt 5A, to a print sheet conveyed from the sheet feed tray 17. The print sheet with the toner image transferred thereon is conveyed to the fixing device 16 by a conveyance portion (not shown). The fixing device 16 includes a heating roller 16A and a pressure roller 16B. The fixing device 16 conveys the print sheet on which the toner image has been transferred, while applying heat and pressure thereto. This allows the toner image to be fused and fixed to the print sheet. The print sheet to which the toner image has been fixed is further conveyed to the downstream side, and discharged to and held by the sheet discharge tray 18 that is arranged above the intermediate transfer unit 5.

The belt cleaning device 6 removes and collects waste toner, namely toner that has remained on the surface of the intermediate transfer belt 5A, and discharges the collected waste toner to a waste toner container 79.

The control portion 8 comprehensively controls an image forming operation of the image forming apparatus 10. The control portion 8 includes a CPU, a ROM, a RAM and the like.

[Toner Replenishment Device]

The following describes the toner replenishment device 40 with reference to FIG. 2 to FIG. 11.

Figure 2:
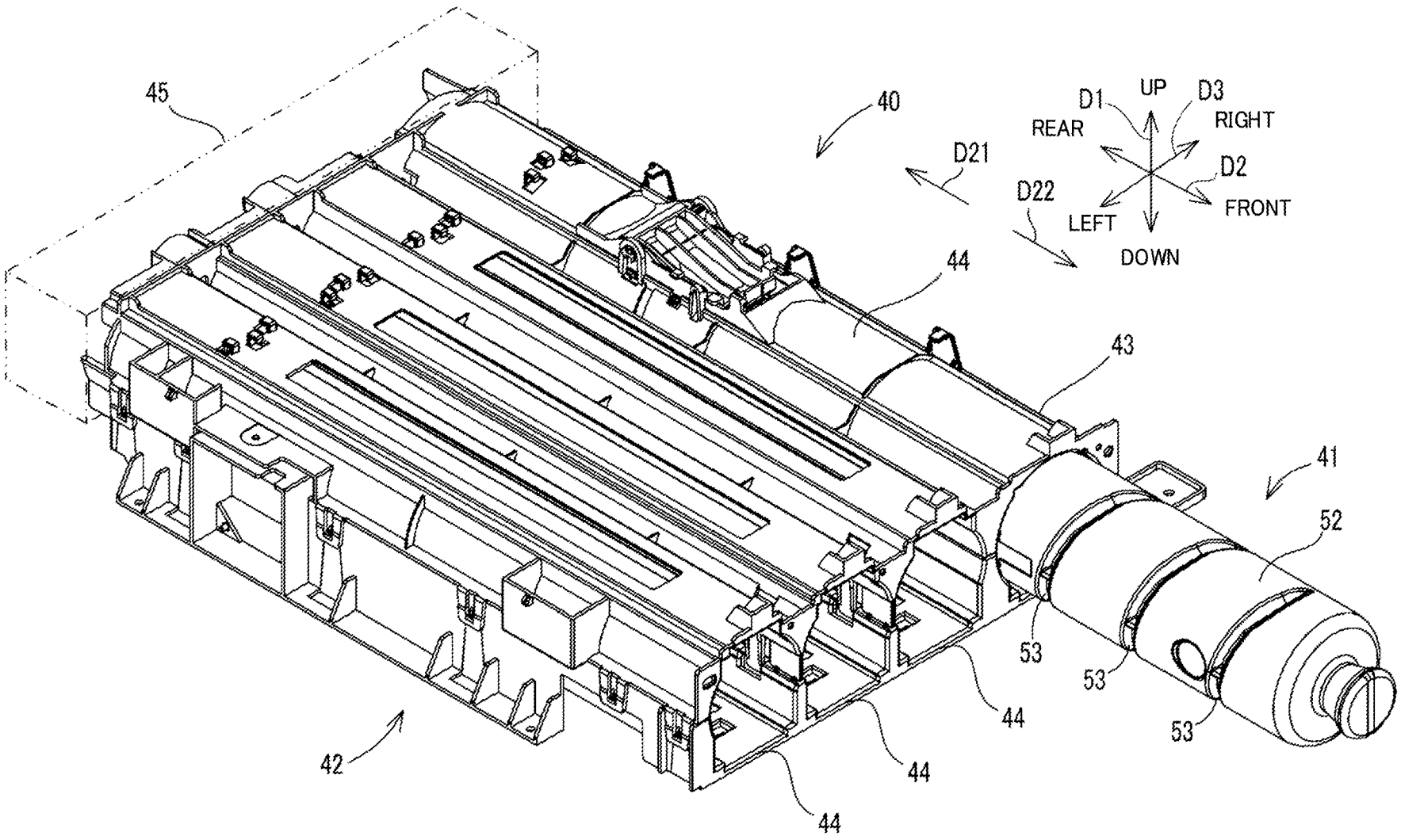
FIG. 2 is a perspective diagram showing a toner replenishment device included in the image forming apparatus.

As shown in FIG. 2, the toner replenishment device 40 includes the toner containers 41 and the container attachment portion 42 to which the toner containers 41 are attached. It is noted that FIG. 2 shows a state where only the toner container 41 for black is attached to the container attachment portion 42. In addition, the up-down direction D1, the front-rear direction D2, and the left-right direction D3 shown in the drawings are defined based on an attachment attitude of the toner replenishment device 40 when it is attached to the housing 11 of the image forming apparatus 10. In addition, in the drawings, an insertion direction of the toner containers 41 is indicated by a sign D21, and a removal direction is indicated by a sign D22.

The toner containers 41 store toner that is replenished to the developing device 23. In the present embodiment, four toner containers 41 corresponding to colors black, yellow, cyan, and magenta are provided in the toner replenishment device 40. It is noted that all the toner containers 41 have the same configuration except that the toner container 41 for black is formed to be larger in outer diameter than the toner containers 41 for the other colors.

Figure 3:
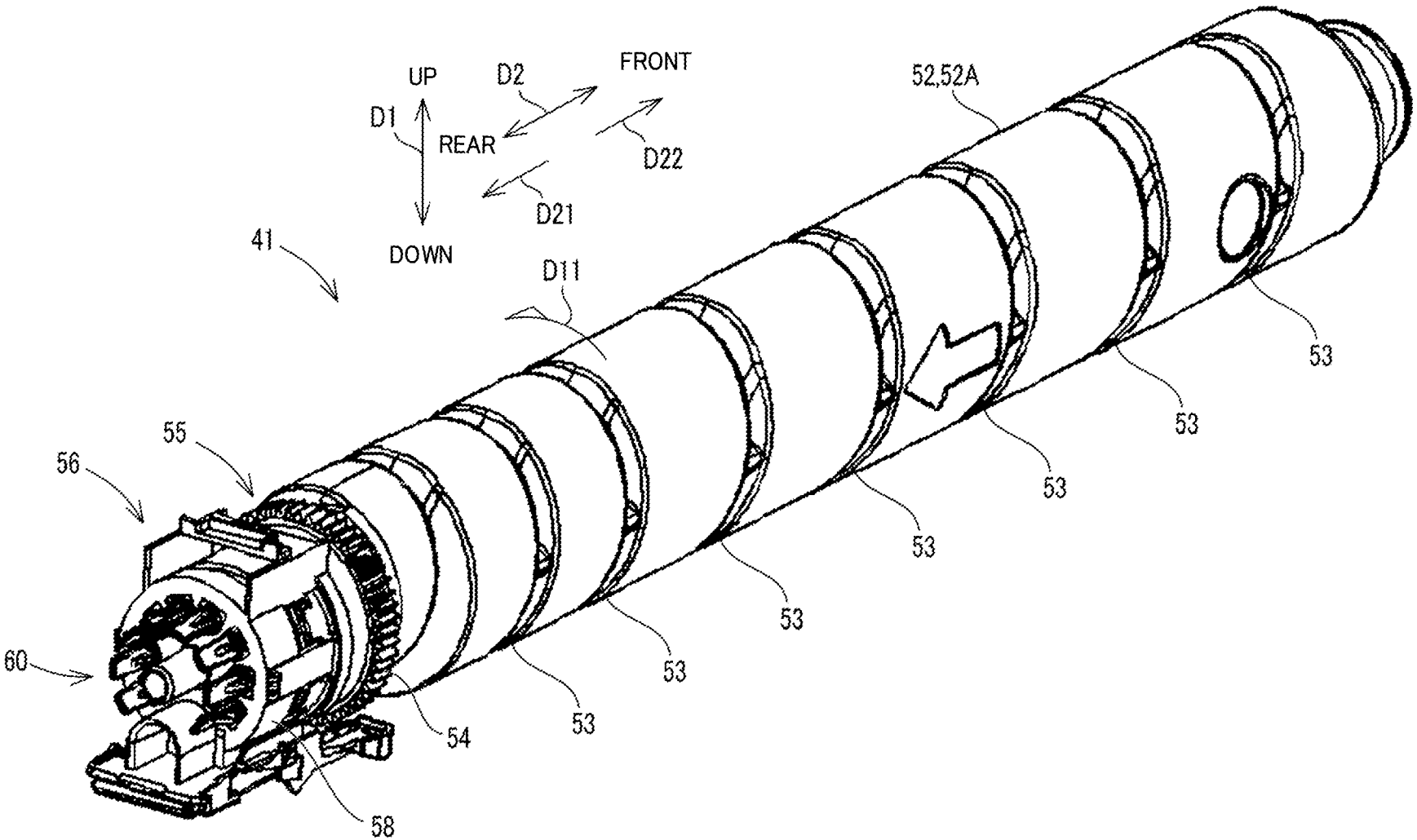
FIG. 3 is a perspective diagram showing a toner container configured to be attached to and detached from the toner replenishment device.

As shown in FIG. 3, the toner containers 41 are formed to be elongated in the front-rear direction D2. Each of the toner containers 41 includes, as major components, a container main body 52, a worm wheel 55, and a coupling member 56.

The container main body 52 is approximately cylindrical in form. The toner is stored in the container main body 52. The container main body 52 has, at an end portion (an example of a tip portion) on one side (rear side) thereof, an outflow port 51 (see FIG. 7) from which the toner flows out. The outflow port 51 is an example of a toner outflow port of the present disclosure. The outflow port 51 is formed at an end portion of the toner container 41 in the insertion direction D21 (on the rear side) in which the toner container 41 is inserted in the toner replenishment device 40. The toner stored inside flows out from the outflow port 51. It is noted that an end portion of the container main body 52 on the other side (front side) is closed. As a result, the container main body 52 is formed in a cylindrical bottle shape.

Figure 7:
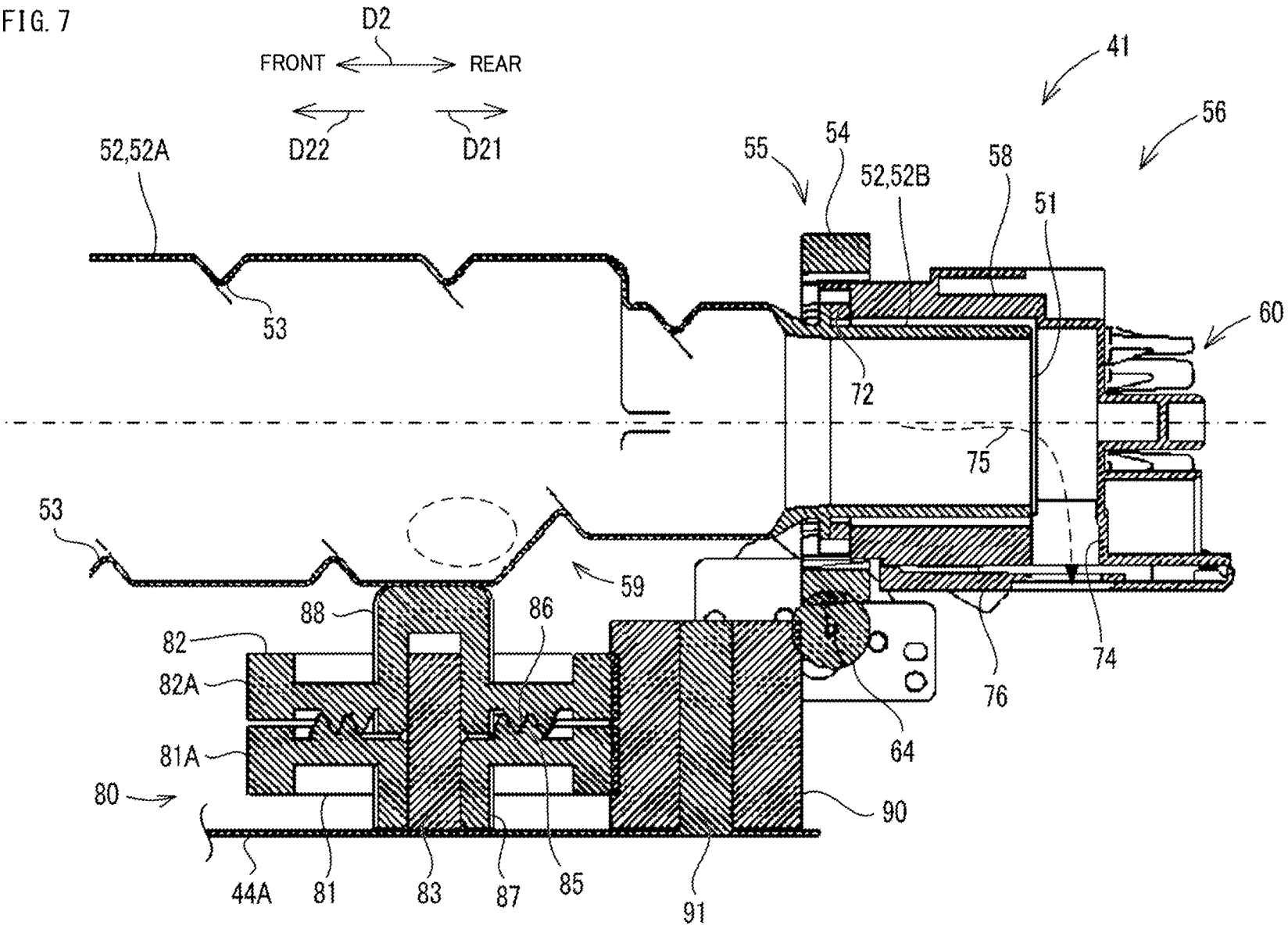
FIG. 7 is a cross section diagram showing a cross section structure of the tip portion of the toner container and the push-up mechanism.

As shown in FIG. 7, the container main body 52 includes a first tubular portion 52A on the front side and a second tubular member 52B on the insertion direction D21 side (rear side). The container main body 52 is a resin molded product made from, for example, a synthetic resin such as polyethylene terephthalate (PET resin) by the blow molding method or the injection molding method. As a result, the first tubular portion 52A and the second tubular portion 52B are integrally formed with each other. The first tubular portion 52A is a cylindrical portion larger in outer diameter than the outflow port 51, and approximately all the toner is stored in the first tubular portion 52A. The second tubular portion 52B is located at a rear end of the container main body 52 and is formed to continue from the first tubular portion 52A. The second tubular portion 52B is a path through which the conveyed toner passes, and has approximately the same outer diameter as the outflow port 51. The second tubular portion 52B is also formed to be cylindrical.

The center lines of the first tubular portion 52A and the second tubular portion 52B are aligned with the center line of the container main body 52. As a result, the container main body 52 includes a step 59 at a boundary between the first tubular portion 52A and the second tubular portion 52B.

As shown in FIG. 3, the container main body 52 includes a conveyance rib 53 as a toner conveyance portion that conveys the toner inside the container main body 52 toward the outflow port 51. That is, the conveyance rib 53 is an example of a toner conveyance portion of the present disclosure. The conveyance rib 53 is formed to be spiral and have a mountain shape with respect to the inner surface of the container main body 52. The conveyance rib 53 projects from the inner surface of the container main body 52 toward the center of the container main body 52. The conveyance rib 53 has a role of conveying the toner inside the container main body 52 toward the outflow port 51 (see FIG. 5).

Figure 4:
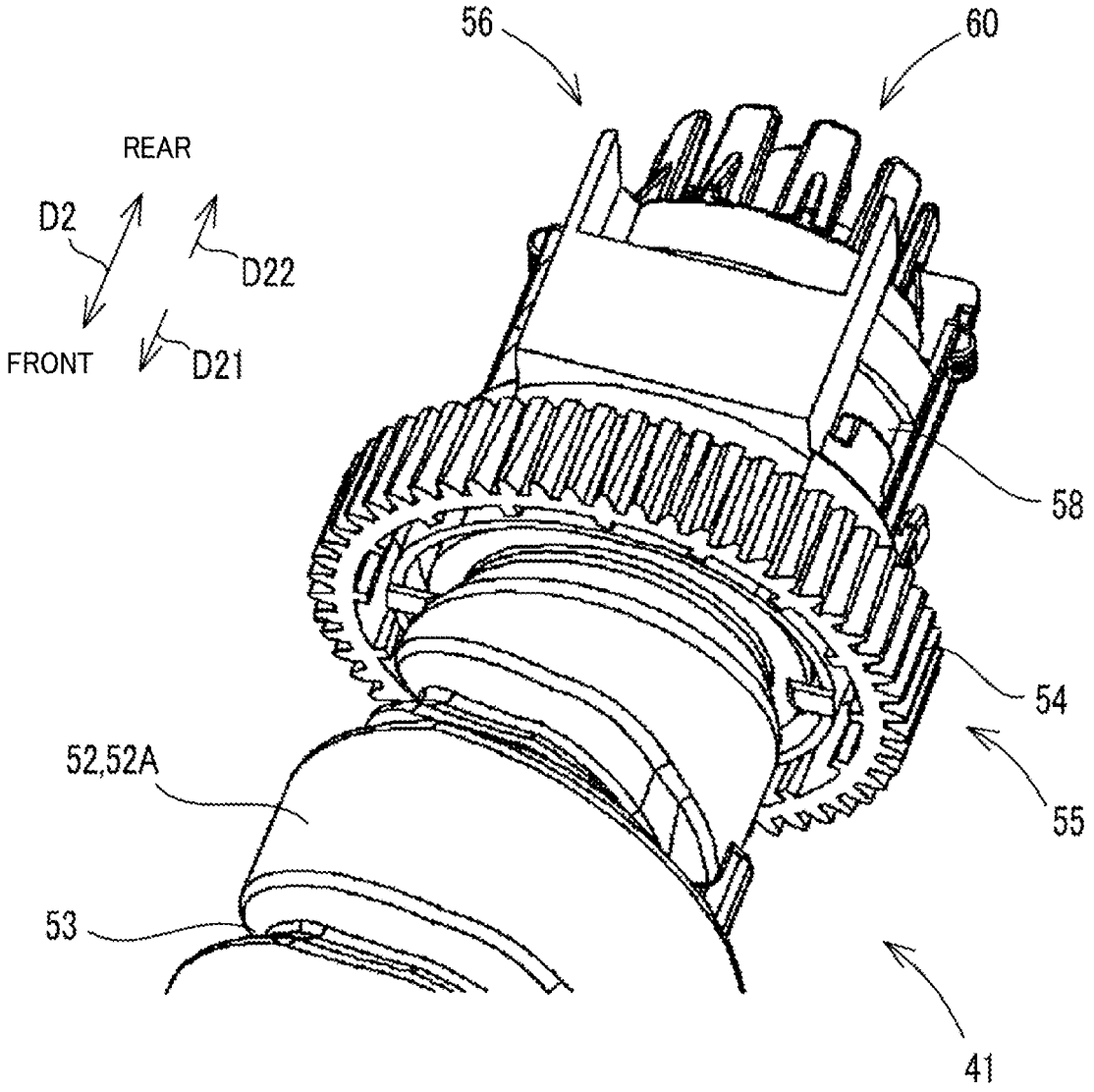
FIG. 4 is an enlarged perspective diagram showing a configuration of a tip portion of the toner container.

As shown in FIG. 4, the worm wheel 55 (an example of a drive transmission portion of the present disclosure) is attached to a rear-end portion of the container main body 52. The worm wheel 55 applies, to the container main body 52, a rotational driving force that is required for the conveyance rib 53 to convey the toner. The worm wheel 55 is fixed to the outer peripheral surface of the second tubular portion 52B. The worm wheel 55 is an annular member attached to the second tubular portion 52B. A gear 54 that is configured to mesh with a worm gear 64 described below is formed on the peripheral surface of the worm wheel 55. The worm wheel 55 is fitted to the second tubular portion 52B and is fixed to the outer peripheral surface of the second tubular portion 52B. Upon receiving a rotational driving force from a motor 65 described below, the worm wheel 55 transmits a rotational driving force for rotation in a direction of the arrow D11, to the toner container 41.

Figure 5:
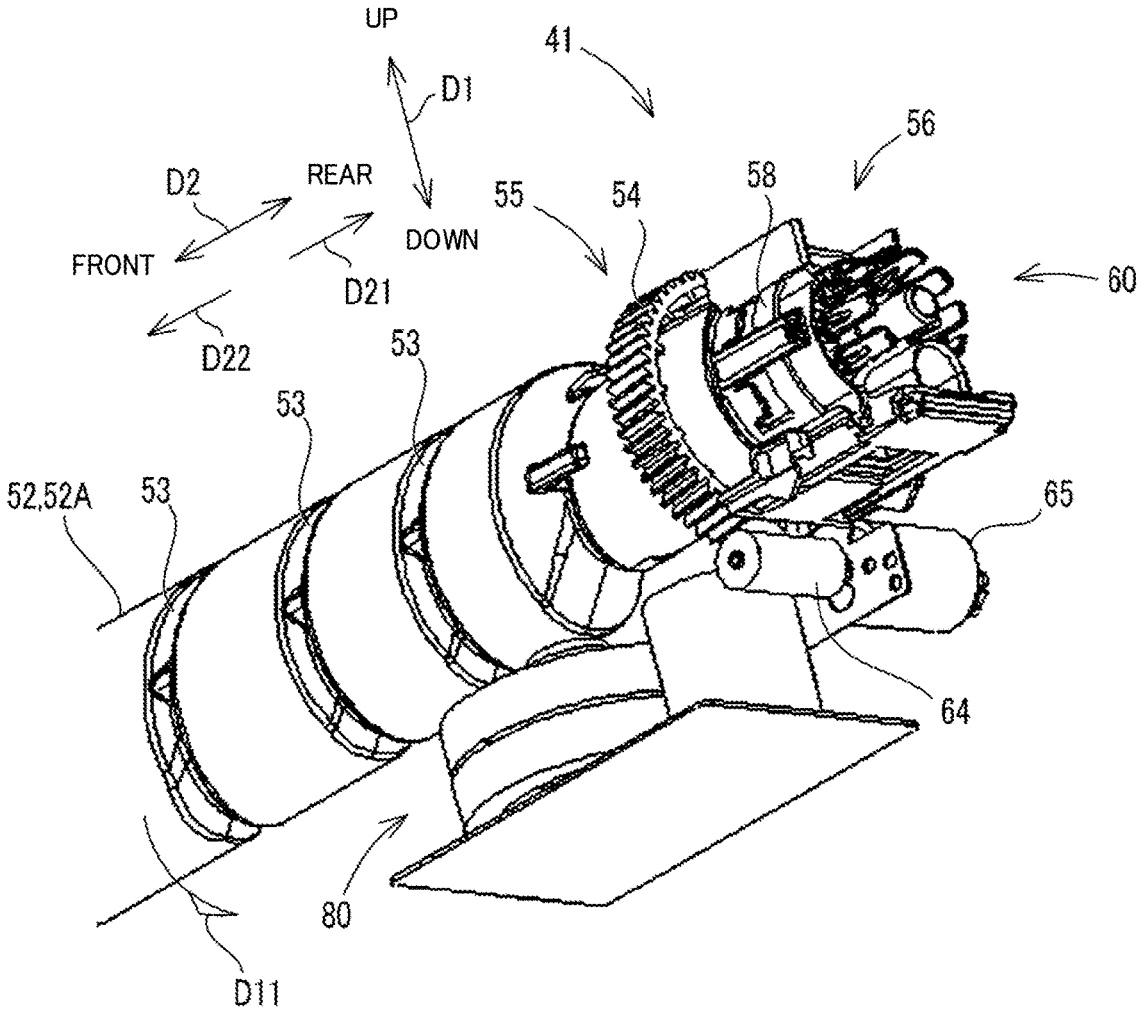
FIG. 5 is a perspective diagram showing the tip portion of the toner container and a push-up mechanism.

As shown in FIG. 5, the toner replenishment device 40 is provided with the worm gear 64 (an example of the drive transmission portion of the present disclosure) and the motor 65, wherein the worm gear 64 meshes with the gear 54 of the worm wheel 55, and the motor 65 outputs the rotational driving force to drive the worm gear 64. The worm gear 64 applies the rotational driving force that is required for the conveyance rib 53 to convey the toner, to the container main body 52 via the worm wheel 55. When a drive signal is input from the control portion 8 to the motor 65 in a state where the toner container 41 is attached to the container attachment portion 42, the motor 65 is driven and outputs the rotational driving force to the worm gear 64. This causes the worm gear 64 to rotate, then causes the worm wheel 55 to rotate, and the container main body 52 rotates in the direction indicated by the arrow D11. As the container main body 52 rotates, the conveyance rib 53 conveys the toner toward the outflow port 51.

The motor 65 includes a holding mechanism that is configured to hold a stopped state to prevent an output shaft from becoming free even when a drive signal is not input or a power supply is interrupted. The holding mechanism may be, for example, a well-known electromagnetic brake or electromagnetic clutch that holds the output shaft when no current is applied. It is noted that the motor 65 is not limited to the one provided with the holding mechanism, but may not be provided with the holding mechanism. In this case, a reduction gear 90 or a push-up mechanism 80 that are described below, may be provided with a holding mechanism, such as an electromagnetic brake or an electromagnetic clutch, that holds the rotation operation of them at a stop position immediately before interruption of the power supply, when the interruption of the power supply occurs.

In the container main body 52, the coupling member 56 is provided more on the insertion direction D21 side (rear side) than the worm wheel 55. The coupling member 56 is attached to an end portion of the container main body 52 on the insertion direction D21 side to cover the outflow port 51. The coupling member 56 is a resin molded product made from, for example, a thermoplastic synthetic resin by the injection molding method.

Figure 6:
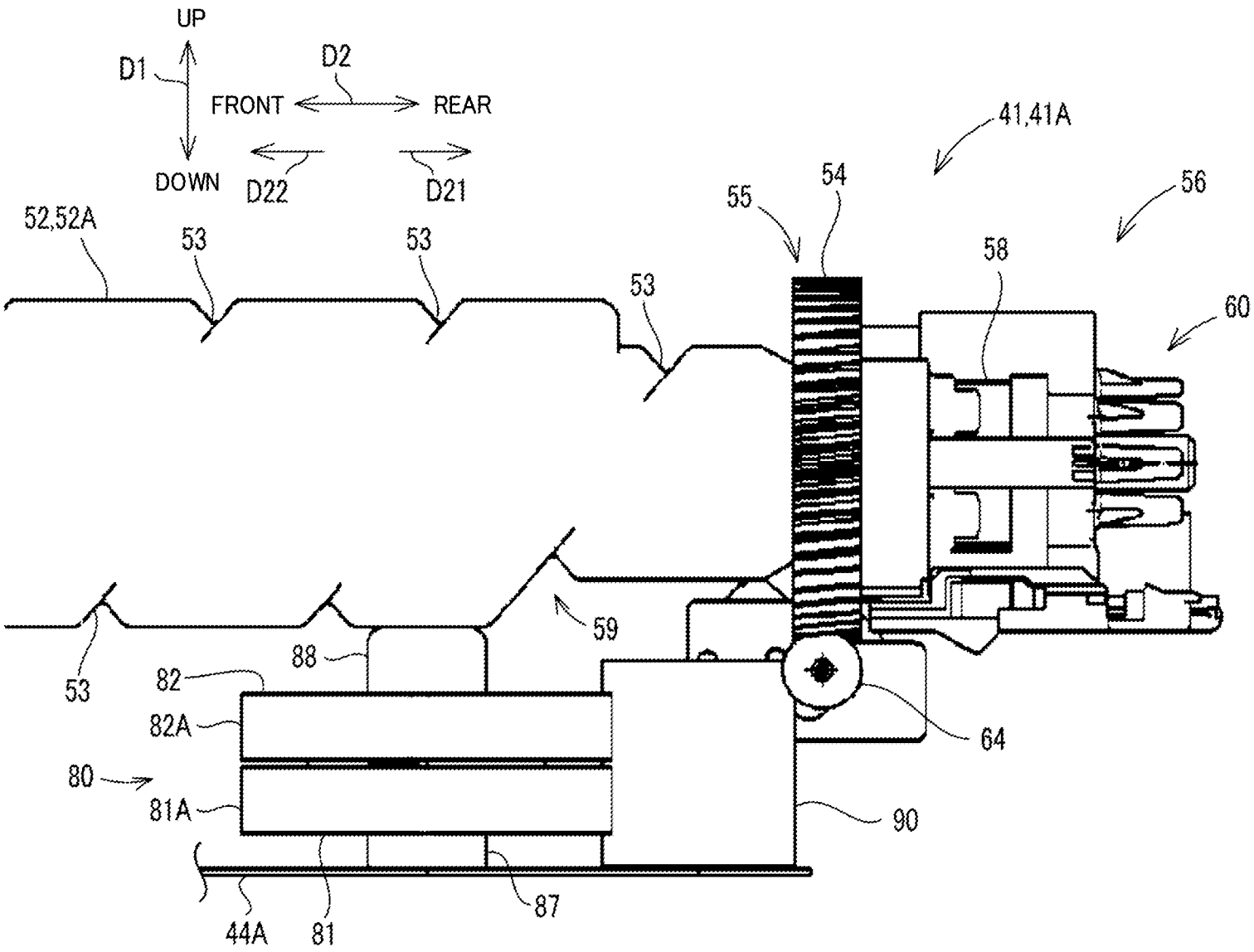
FIG. 6 is a side diagram showing the tip portion of the toner container and the push-up mechanism.

As shown in FIG. 6, the coupling member 56 includes a cylindrical storage frame 58 in which the second tubular portion 52B including the outflow port 51 (see FIG. 5) is inserted in a state where the coupling member 56 is attached to the container main body 52. This allows the outflow port 51 to be inserted in the storage frame 58, and the outflow port 51 is covered with the storage frame 58. The storage frame 58 supports the second tubular portion 52B such that the second tubular portion 52B can pivot in the circumferential direction. As a result, in a state where the second tubular portion 52B is inserted in the storage frame 58, the container main body 52 can pivot in the circumferential direction.

As shown in FIG. 7, the coupling member 56 is attached to the second tubular portion 52B of the container main body 52 via a seal member 72. The seal member 72 is an annular member attached to the outer peripheral surface of the second tubular portion 52B, and is made from an elastic member such as a sponge member or a rubber member. The seal member 72 is disposed inside the worm wheel 55, and is provided in such a way as to fill the gap between the storage frame 58 and the outer peripheral surface of the second tubular portion 52B.

When the toner container 41 is inserted in the container attachment portion 42 (see FIG. 2), a coupling portion 60 (see FIG. 3) of the coupling member 56 is coupled with a coupled portion (not shown) of the container attachment portion 42, and the toner container 41 is attached to and supported by the container attachment portion 42 at a predetermined attachment position. When the coupling portion 60 is coupled with the coupled portion, the coupling member 56 is restricted from rotating in the circumferential direction of the toner container 41. In the present embodiment, in a state where the toner container 41 is attached to the container attachment portion 42, the coupling member 56 is prohibited from rotating in the circumferential direction, but the container main body 52 is supported in such a way as to pivot in the circumferential direction in the container attachment portion 42.

When the rotational driving force is transmitted to the worm wheel 55 in the state where the toner container 41 is attached to the container attachment portion 42, the container main body 52 is rotated by the rotational driving force in a rotation direction indicated by the arrow D11 (see FIG. 3). That is, in a state where the toner can be supplied from the toner container 41 to the developing device 23, the toner container 41 rotates around its longitudinal direction. When the container main body 52 of the toner container 41 rotates in this way, the toner is pressed and conveyed by the conveyance rib 53 toward the outflow port 51 (rearward).

As shown in FIG. 7, the coupling member 56 includes a toner discharge port 74. The toner discharge port 74 is used to discharge the toner from the container main body 52 to outside, and is provided at an outer peripheral wall of the coupling member 56. Referring to FIG. 5, the toner discharge port 74 is provided at a lower portion of the coupling member 56. The toner discharge port 74 is a rectangular through hole that passes through the outer peripheral wall of the coupling member 56. A toner passage 75 is formed inside the coupling member 56 between the outflow port 51 and the toner discharge port 74. When the toner container 41 is attached to the container attachment portion 42 (see FIG. 2) with the toner discharge port 74 facing downward, the toner flows out from the outflow port 51 of the container main body 52, passes the toner passage 75 to move downward, and reaches the toner discharge port 74. At this time, in a case where the toner discharge port 74 is open, the toner is discharged downward from the toner discharge port 74 to outside. This allows the toner to be replenished to the developing device 23. On the other hand, in a case where the toner discharge port 74 is closed by a shutter member 76, the toner is not discharged, and the toner passage 75 is filled with the toner.

As shown in FIG. 2, the container attachment portion 42 includes a storage case 43 and a coupling support portion 45, wherein the storage case 43 includes four storage portions 44, and the coupling support portion 45 is attached to a back surface of the storage case 43. It is noted that in FIG. 2, the coupling support portion 45 is indicated by a two-dot chain line.

The storage portions 44 of the storage case 43 are configured to store the toner containers 41 that respectively store predetermined different colors of toner. The storage portions 44 respectively support the toner containers 41 such that the toner container 41 can be inserted toward the attachment positions in the storage portions 44. In the present embodiment, the container attachment portion 42 supports the toner containers 41 in the storage portions 44 in a state where the toner containers 41 are laid transversely, namely, in a horizontal state.

The coupling support portion 45 is coupled with the coupling portions 60 of the toner containers 41 inserted in the storage portions 44 in such a way as to fix the rear end portions of the toner containers 41, and position the toner containers 41 at the attachment positions in the storage portions 44. The coupling support portion 45 is mounted independent of the storage case 43, and is attached to the storage case 43 or an internal frame of the housing 11. The coupling support portion 45 is provided with four coupled portions in correspondence with the four storage portions 44. It is noted that in the container attachment portion 42, the coupling support portion 45 and the storage case 43 may be integrally formed.

In the present embodiment, the toner replenishment device 40 further includes the push-up mechanism 80 (an example of a biasing mechanism of the present disclosure) configured to tilt the attached toner container 41. As described above, the container main body 52 of the toner container 41 includes the first tubular portion 52A and the second tubular portion 52B, and the step 59 (see FIG. 7) is formed at the boundary therebetween. As the toner is conveyed to be used and the remaining amount of toner becomes small, some amount of toner may not be conveyed by the conveyance rib 53 and remain at a portion (see a portion surrounded by a dotted line in FIG. 7) located more on the front side than the step 59. When the toner remains in this way, the toner in the container cannot be used up. On the other hand, in the present embodiment, the push-up mechanism 80 is provided in the toner replenishment device 40. This makes it possible to convey the toner even when the remaining amount of toner becomes small, thereby preventing reduction in the toner conveyance efficiency. In addition, it is possible to reduce an amount of toner that remains unused in the toner container 41.

The following describes a configuration of the push-up mechanism 80.

The push-up mechanism 80 is provided in each of the four storage portions 44 of the container attachment portion 42. The push-up mechanism 80 applies a biasing force to the toner container 41 in accordance with the conveyance operation of the conveyance rib 53 so that the attitude of the container main body 52 of the toner container 41 changes from the horizontal attitude to an inclined attitude described below. As shown in FIG. 6 and FIG. 7, in the present embodiment, the push-up mechanism 80 is installed on a bottom surface 44A of each storage portion 44.

When a toner conveyance operation is performed by the conveyance rib 53 in conjunction with the rotation of the container main body 52, the push-up mechanism 80 branches and receives a rotational driving force from the worm gear 64 and thereby changes the container main body 52 of the toner container 41 from the horizontal attitude to the inclined attitude.

Figure 10:
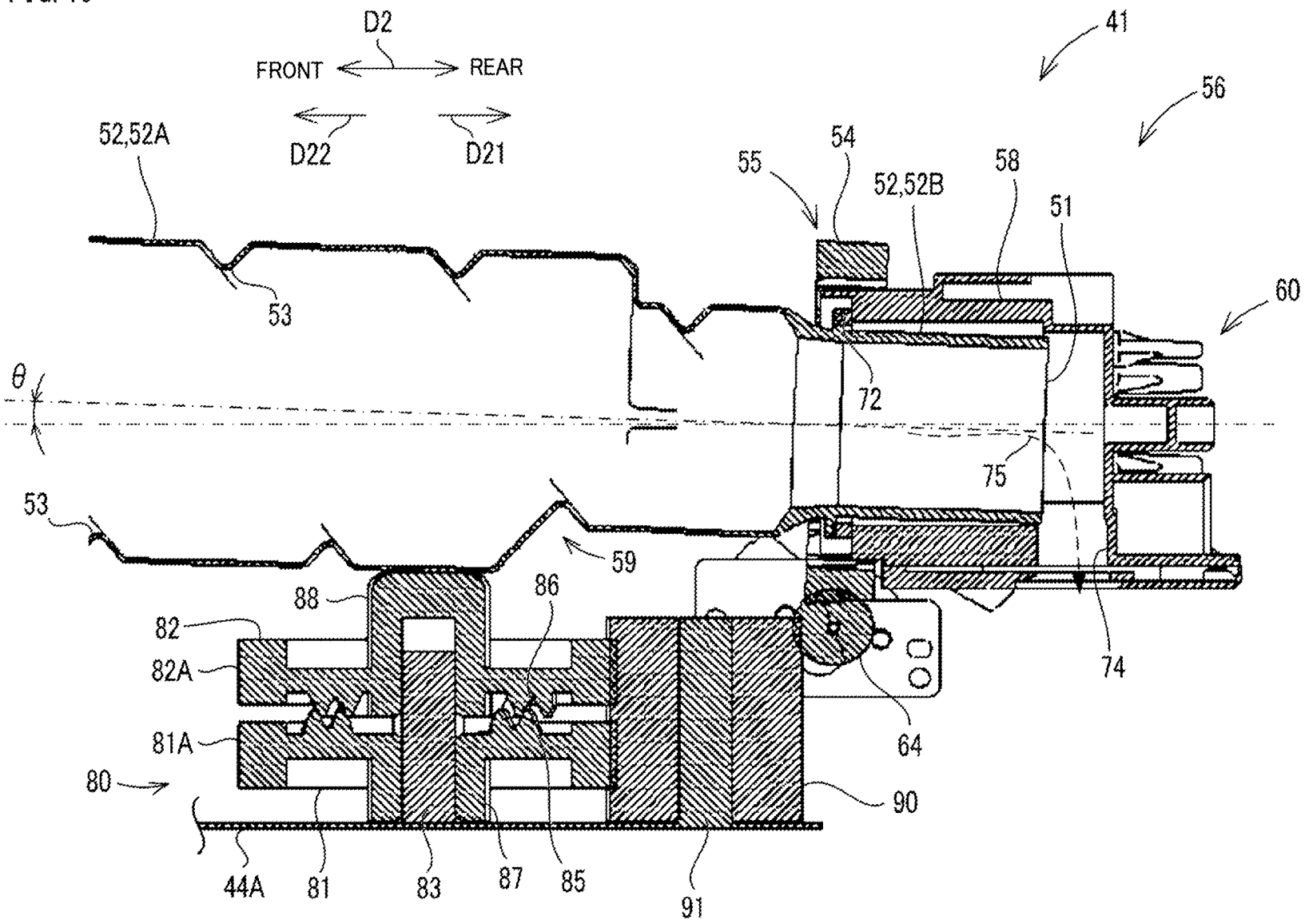
FIG. 10 is a cross section diagram showing a state where the toner container is inclined by the push-up mechanism.

Here, in the horizontal attitude, the toner container 41 is laid horizontally as shown in FIG. 7. More specifically, in the horizontal attitude, the center line of the container main body 52 and the horizontal line approximately match each other. On the other hand, as shown in FIG. 10, in the inclined attitude, only the container main body 52 is displaced upward, with a position where the coupling member 56 is attached to the second tubular portion 52B, as a fulcrum while the coupling member 56 of the toner container 41 is fixed to the container attachment portion 42. More specifically, in the inclined attitude, the container main body 52 is inclined at angle θ (see FIG. 10) from the horizontal attitude. In the inclined attitude, the outflow port 51 faces diagonally downward on the rear side. Here, the attachment position is a position at which the coupling member 56 is attached to the second tubular portion 52B, and more specifically a position sealed by the seal member 72 (namely, a position where the seal member 72 is provided). In addition, the angle θ is determined to be in a range in which the sealing effect of the seal member 72 is not damaged and in which the storage portion 44 and the toner container 41 do not interfere with each other.

As shown in FIG. 7, the push-up mechanism 80 is provided below the container main body 52, and includes a rotary shaft 83, a first spur gear 81, and a second spur gear 82, wherein the first spur gear 81 and the second spur gear 82 are rotatably supported by the rotary shaft 83. The rotary shaft 83, a member of a round rod shape, is provided to stand on the bottom surface 44A and extend in the up-down direction D1. The first spur gear 81 and the second spur gear 82 are formed to have the same diameter and the same size, and gears 81A and 82A are formed respectively on the outer peripheral surfaces thereof. The rotational driving force from the worm gear 64 is transmitted to each of the first spur gear 81 and the second spur gear 82.

In the present embodiment, the rotational driving force from the worm gear 64 is not directly transmitted to each of the first spur gear 81 and the second spur gear 82, but is transmitted with a reduced rotational speed in accordance with an upward push-up amount of the container main body 52. As a result, the reduction gear 90 provided between the worm gear 64 and the spur gears 81 and 82 is designed to have a predetermined reduction ratio. The reduction gear 90 meshes with the worm gear 64, the first spur gear 81, and the second spur gear 82. It is noted that the reduction gear 90 is rotatably supported by a rotary shaft 91 that is provided to stand on the bottom surface 44A.

At the rotary shaft 83, the first spur gear 81 is disposed at a lower position, and the second spur gear 82 is disposed above the first spur gear 81. The first spur gear 81 includes a tubular support portion 87 that projects downward from a central portion of a lower surface of the first spur gear 81. The support portion 87 is supported by the bottom surface 44A in a state where the rotary shaft 83 is inserted in an inner hole of the support portion 87.

Figure 9:
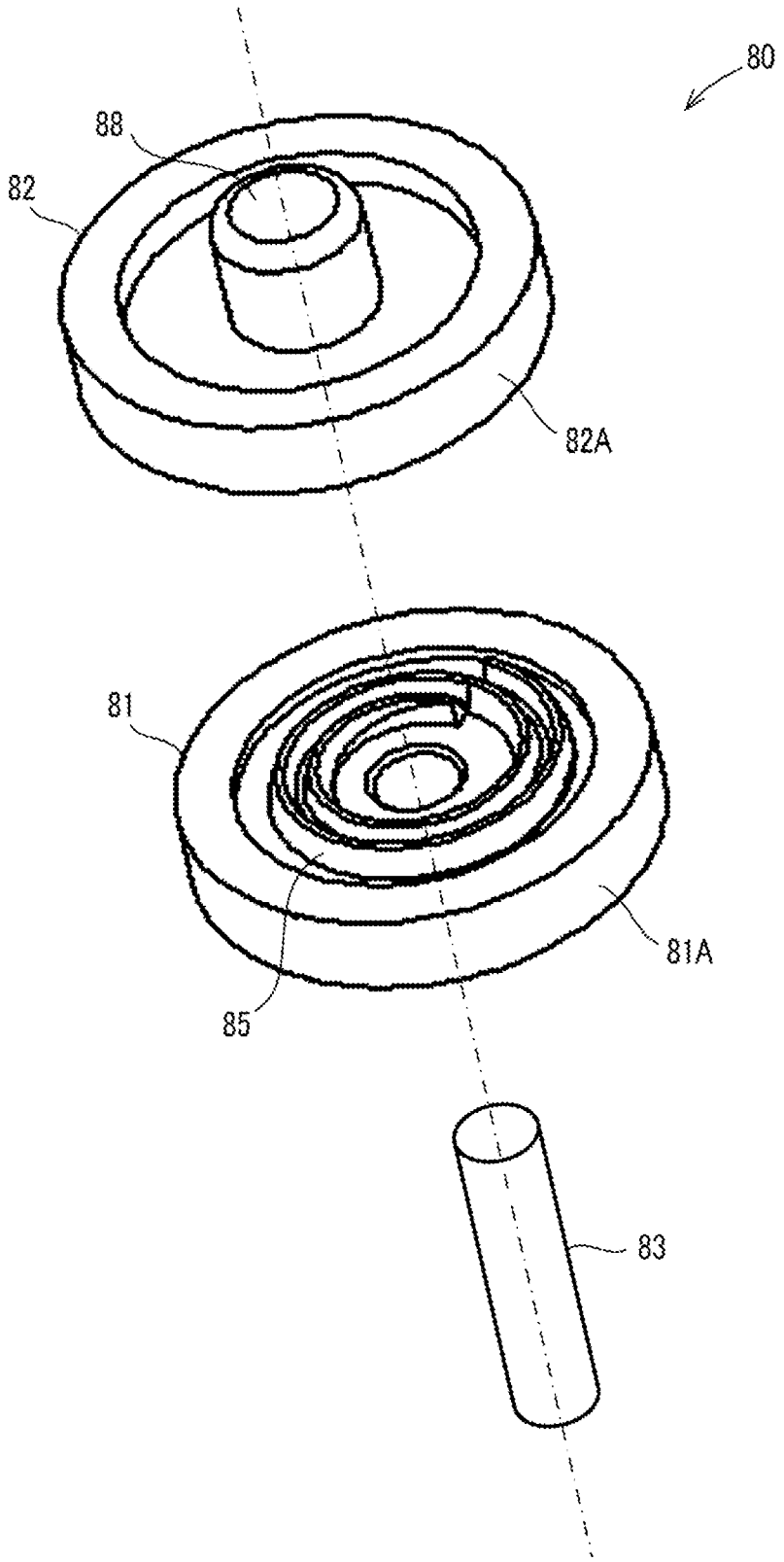
FIG. 9 is a disassembled perspective diagram of the push-up mechanism.

As shown in FIG. 9, a spiral rib 85 (an example of an engaging portion of the present disclosure) having a triangular cross section is formed on an upper surface of the first spur gear 81, wherein the spiral rib 85 is formed in the shape of a spiral having the rotary shaft 83 as the center point. In addition, a spiral groove 86 (an example of an engaged portion of the present disclosure, see FIG. 7) of a spiral shape is formed on a lower surface of the second spur gear 82 such that the spiral rib 85 is inserted in the spiral groove 86. The spiral groove 86 has an inverse triangular cross section. As a result, when the upper surface of the first spur gear 81 and the lower surface of the second spur gear 82 are fitted to each other, the spiral rib 85 is inserted in the spiral groove 86, and the surfaces are connected to each other without a gap.

In the present embodiment, when the rotational driving force is input from the reduction gear 90 to the first spur gear 81 and the second spur gear 82, the second spur gear 82 gradually goes up relative to the first spur gear 81. A pressing portion 88, a projection projecting upward, is formed at the center of the upper surface of the second spur gear 82. As a result, as the second spur gear 82 goes up, the pressing portion 88 presses the outer peripheral surface of the container main body 52 upward. As the pressing portion 88 presses the container main body 52 upward, the container main body 52 gradually goes up (is gradually inclined), with a position where the coupling member 56 is attached to the second tubular portion 52B, as a fulcrum.

A pressure position pressed by the pressing portion 88 is determined to be a predetermined position more on the front side than the worm wheel 55. The pressure position is determined to be a position that corresponds to the angle θ in the inclined attitude of the container main body 52.

Figure 8:
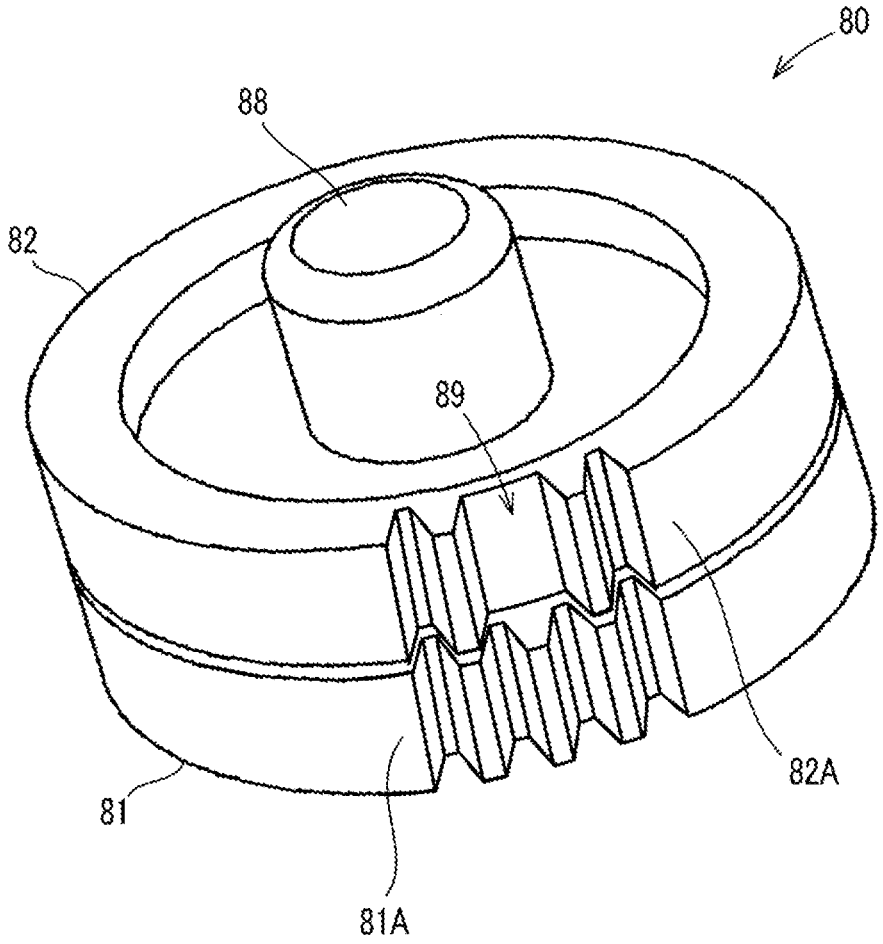
FIG. 8 is a perspective diagram of the push-up mechanism.

As shown in FIG. 8, in order for the second spur gear 82 located at an upper position to go up, the gear 82A of the second spur gear 82 includes an untoothed portion 89 that lacks at least one tooth. On the other hand, the gear 81A of the first spur gear 81 does not lack a tooth. It is noted that FIG. 8 shows only a part of teeth of the gears 81A and 82A, and the other part of the teeth is omitted.

In the present embodiment, the untoothed portion 89 is provided only in the second spur gear 82. With this configuration, upon transmission of the rotational driving force from the reduction gear 90 to the push-up mechanism 80, each time the first spur gear 81 and the second spur gear 82 make one rotation, the second spur gear 82 delays with respect to the first spur gear 81 by a rotation amount corresponding to one tooth. The rotation delay causes the outer surface of the spiral rib 85 to be pressed against the inner surface of the spiral groove 86, thereby generating an upward force. The upward force slightly pushes up the second spur gear 82.

When the container main body 52 is rotated by the rotational driving force of the worm gear 64, and the toner is conveyed by the conveyance rib 53, the second spur gear 82 goes up in accordance with the conveyance operation. That is, when the first spur gear 81 and the second spur gear 82 rotate, and each time the second spur gear 82 makes one rotation, the second spur gear 82 slightly goes up. Accordingly, as the toner in the container main body 52 is gradually reduced with the conveyance operation, the container main body 52 is displaced from the horizontal attitude toward the inclined attitude, and when the toner conveyance operation is further continued, the container main body 52 is inclined to be in the inclined attitude. In this way, the container main body 52 changes its attitude in accordance with the toner conveyance operation, and the container main body 52 is inclined when the remaining amount of toner becomes small. With this configuration, compared with a case where the container main body 52 is always in the horizontal attitude, the toner conveyance force is not reduced, and it is possible to prevent reduction in the toner conveyance efficiency. In addition, the unused toner becomes likely to be conveyed due to the presence of the step 59 in the container main body 52. As a result, when it is detected that a container of the container main body 52 is substantially empty, namely, when the timing for replacing the toner container 41 has come, there is almost no toner inside. That is, it is possible to use the toner in the container main body 52 as completely as possible.

It is noted that in the above-described embodiment, the push-up mechanism 80 includes the first spur gear 81 and the second spur gear 82. However, the push-up mechanism 80 is not limited to the configuration. For example, the push-up mechanism 80 may include a cam mechanism that causes the container main body 52 to go up gradually by receiving a rotational driving force that is input as the reduction gear 90 rotates. The cam mechanism may be, for example, a plate cam (circumference cam), a front cam (grooved cam), a rotating plate cam, a cylindrical cam, a spherical cam, or an end-face cam that are well known.

In addition, when the toner container 41 becomes empty of toner and is removed for replacement, it is necessary to return the container main body 52 from the inclined attitude to the horizontal attitude. For this reason, it is preferable that, upon determining, based on an output signal from a sensor or the like, that the toner container 41 was removed, the control portion 8 outputs, to the motor 65, a drive signal to cause the motor 65 to rotate in a direction opposite to the toner conveyance operation by a predetermined amount so that the second spur gear 82 of the push-up mechanism 80 returns to an initial position to come in contact with the first spur gear 81.

In addition, the present embodiment shows, as one example, a configuration where the first spur gear 81 includes the spiral rib 85, and the second spur gear 82 includes the spiral groove 86. However, not limited to the configuration, for example, the first spur gear 81 may include the spiral groove 86, and the second spur gear 82 may include the spiral rib 85.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner container having a toner outflow port at a tip portion thereof;

a toner conveyance portion provided in the toner container and configured to convey toner in the toner container toward the toner outflow port;

a container attachment portion supporting the toner container; and a biasing mechanism configured to apply a biasing force to change the toner container from a horizontal attitude to an inclined attitude in accordance with a toner conveyance operation of the toner conveyance portion, wherein when the toner container is in the inclined attitude, the toner outflow port faces diagonally downward; and a drive transmission portion configured to apply a force that is required for the toner conveyance operation, to the toner conveyance portion, wherein the biasing mechanism receives a force branched from the drive transmission portion to change the toner container from the horizontal attitude to the inclined attitude;

the toner conveyance portion includes:

a spiral mountain-shaped rib provided on an inner surface of the toner container, the drive transmission portion includes:

a worm wheel provided on an outer peripheral surface of the toner container; and a worm gear configured to transmit a predetermined rotational driving force to the worm wheel, and the image forming apparatus further comprises:

a reduction gear configured to receive the rotational driving force from the worm gear and transmit the rotational driving force with a reduced speed to the biasing mechanism.

2. The image forming apparatus according to claim 1, wherein the toner container includes:

a tubular container main body having the toner outflow port at a tip portion thereof and storing the toner inside thereof; and a coupling member provided at the tip portion of the container main body via a seal member, the container attachment portion is configured to be coupled with the coupling member in a state where the toner container is attached to the container attachment portion, the worm wheel is provided on an outer peripheral surface of the container main body, and the biasing mechanism applies the biasing force to the container main body at a predetermined position more on a rear end side than the worm wheel.

3. The image forming apparatus according to claim 2, wherein upon receiving the rotational driving force with the reduced speed from the reduction gear, the biasing mechanism goes up and presses the container main body to change an attitude of the container main body.

4. The image forming apparatus according to claim 3, wherein the biasing mechanism includes:

a rotary shaft provided below the toner container and extending in an up-down direction;

a first spur gear rotatably supported by the rotary shaft, wherein a spiral engaging portion is formed on an upper surface of the first spur gear; and a second spur gear provided above the first spur gear and rotatably supported by the rotary shaft, wherein a spiral engaged portion is formed on a lower surface of the second spur gear so that the engaging portion can be inserted in the engaged portion, wherein the first spur gear and the second spur gear mesh with the reduction gear, and the second spur gear includes an untoothed portion that lacks at least one tooth.

5. The image forming apparatus according to claim 2, wherein the container main body includes a first tubular portion and a second tubular portion, wherein the first tubular portion is larger in outer diameter than the toner outflow port, and the second tubular portion is formed to continue from the first tubular portion and has approximately a same outer diameter as the toner outflow port, and the coupling member is attached to the second tubular portion.

* * * * *